United States Patent [19]

Costar

[11] Patent Number: 4,685,752

[45] Date of Patent: Aug. 11, 1987

[54] ELECTRICAL CONNECTOR

[76] Inventor: Lowell W. Costar, 5017 N. 115th St., Omaha, Nebr. 68164

[21] Appl. No.: 915,558

[22] Filed: Oct. 6, 1986

[51] Int. Cl.[4] ..... H01R 13/648

[52] U.S. Cl. ..... 439/96

[58] Field of Search ..... 339/14 L, 75 R, 12 V, 339/93 R, 93 C, 125 R, 60 R, 61 R, 252 R, 254 R; 174/6; 204/196, 197

[56] References Cited

U.S. PATENT DOCUMENTS

| | | | |
|---|---|---|---|
| 2,557,434 | 6/1951 | Hoverder | 339/12 V |
| 2,759,160 | 8/1956 | Kelley | 339/12 V |
| 3,013,241 | 12/1961 | Wing | 339/14 L |
| 3,411,125 | 11/1968 | Hill | 339/12 V |

FOREIGN PATENT DOCUMENTS

| | | | |
|---|---|---|---|
| 237189 | 8/1945 | Switzerland | 339/12 V |

*Primary Examiner*—John McQuade
*Attorney, Agent, or Firm*—George R. Nimmer

[57] ABSTRACT

The electrical connector is physically attached to the external surface of a metallic structure (and which might contain flammable fluid) solely by virture of an annular layer of resinous adhesive. The annular adhesive layer is carried by the centrally-open lower-side of a frame member to provide vertically aligned central-openings for the adhesive and the frame member lower-side. At least one electrically conductive and upwardly deflectable contact member is located within the frame member and includes a contact member lower free-end protruding through the vertically aligned central-openings so that the free-end is initially disposed below the adhesive layer. However, once the electrical connector is physically adhesively attached to the metallic structure external surface, the contact member free-end is in electrically conductive abutment against the metallic structure external surface, and hence, is substantially co-elevational with the adhesive layer physical attachment. An electrically conductive terminal member, which might be connected to an electrons source, is in electrically conductive relationship to the contact member. In a preferred embodiment, the contact member takes the form of two cantilevered leaf springs protruding downwardly through a pair of vertically aligned central-openings.

12 Claims, 15 Drawing Figures

FIG. 10
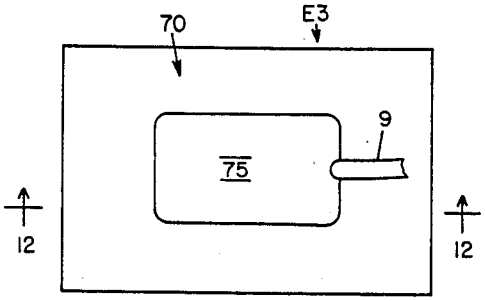
FIG. 11
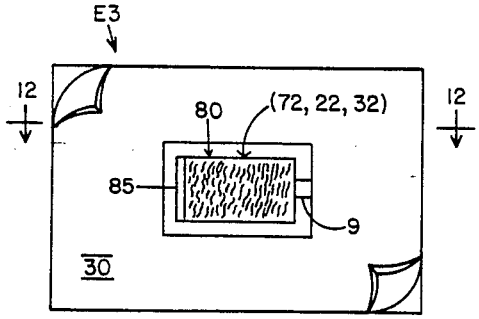
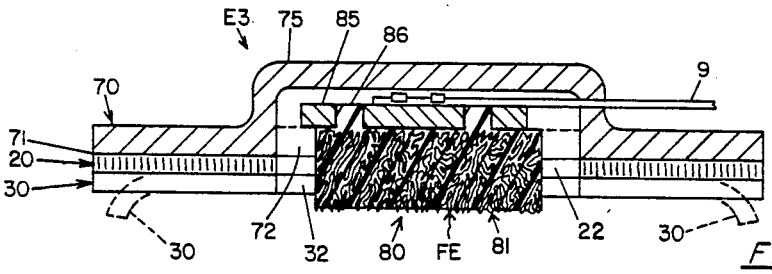
FIG. 12
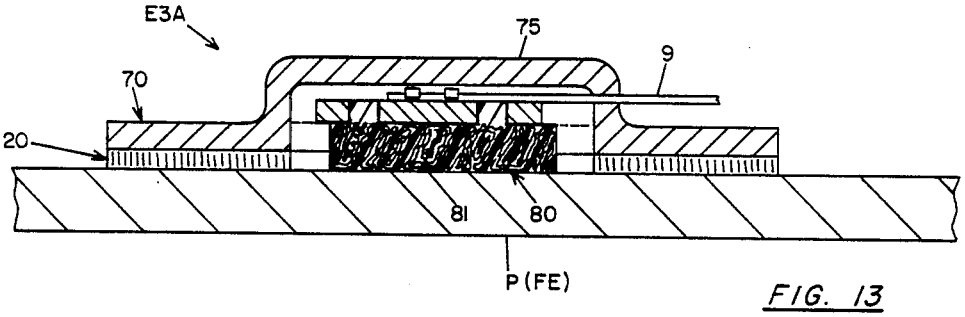
FIG. 13
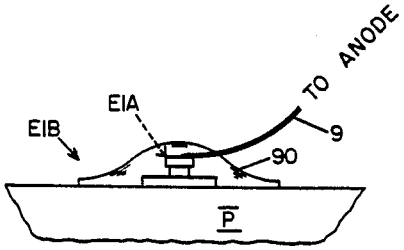
FIG. 4A
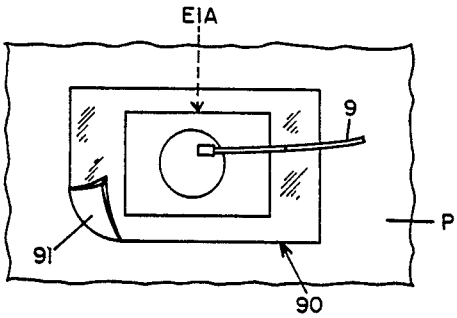
FIG. 5A

ELECTRICAL CONNECTOR

BACKGROUND OF THE INVENTION

Flammable liquids and gases are commonly stored in or transmitted through metallic structures such as ferrous tanks and pipelines. Especially in electrolytic environments (such as soils, moisture, etc.) metallic structures tend to corrode and even to an eventual extent that the flammable fluid will escape and present fire hazards.

Accordingly, cathodic protection for aforementioned metallic structures is desireable. Cathodic protection is broadly defined to mean the steady conveyance of electrons from an external source to the metallic structure. Accordingly, cathodic protection might entail the connection of an elongate electrically conductive wire between a storage tank or transmission pipeline metallic structure and the external source of electrons. The electrons source might be an electrical generator apparatus or even simply an anodic chemical element (e.g. magnesium, zinc, etc.) having an empirical rating on the "Electromotive Force Series of Metals" (i.e. EMS) that is relatively higher than is the EMS rating for the metallic structure. However, as is appreciated in the prior art, connecting the elongate wire to a tank or pipeline metallic structure invariably necessitates the very expensive fire-prevention step of initially purging the flammable fluid prior to making a mechanical or high-temperature connection to the tank or pipeline. For example, mechanical connections deliberately puncture the tank or pipeline, and welds or chemically exothermic processes are apt to produce hairline cracks in the metallic tank or piping; in either case, the escaping flammable fluid can ignite to endanger the workers and environs.

OBJECT OF THE INVENTION

It is accordingly the general objective of the present invention to effect a non-puncturing and low-temperature physically attachable electrical connector between the elongate electrons conveying wire and the metallic structure. Thus, for example, it would become unnecessary to employ the very expensive initial step of purging flammable fluid from a storage tank or pipeline metallic structure.

GENERAL STATEMENT OF THE INVENTION

With the aforementioned general objective in view, and together with more specific objectives which will become apparent as this description proceeds, the electrical connector concept of the present invention generally comprises: a frame member including a substantially horizontal and linearly generated lower-side that is provided with at least one central-opening, and the frame member including a housing portion overlying the lower-side central-opening; and electrically insulative laminar adhesive carried by and extending horizontally along the frame member lower-side and including at least one central-opening in vertical alignment with a frame member lower-side central-opening; at least one electrically conductive contact member within the frame member housing portion and including a free-end protruding through said at least one vertically aligned central-openings, whereby said free-end is initially at an elevation below that of the laminar adhesive, and said contact member being upwardly movable to an extent that, when the electrical connector device is physically attached to the metallic structure linearly generated external surface, said free-end is substantially co-elevational with the laminar adhesive and in electrically conductive surface abutment with the metallic structure; an electrically conductive terminal member attached in electrically conductive relationship to the contact member; and together with other permissible and desireable optional features which will be pointed out in the detailed description of the drawings.

BRIEF DESCRIPTION OF THE DRAWING

In the drawing, wherein like characters refer to like parts in the several views, and in which:

FIG. 4A is a side elevational schematic view of embodiment E1 in a further augmented encased condition E1B;

FIG. 5A is a top plan schematic view of embodiment E1 in the augmented condition E1B;

FIG. 10 is a top plan view of a third embodiment E3 of the adhesively attachable electrical connector;

FIG. 11 is a bottom plan view of embodiment E3;

FIG. 12 is a sectional elevational view, similar to FIGS. 3 and 9, and taken along lines 12—12 of FIGS. 10 and 11; and FIG. 13 is a sectional elevational view, similar to FIG. 6, showing third embodiment E3 in a physically attached condition E3A to a pipeline metallic structure.

DETAILED DESCRIPTION OF THE DRAWING

Figure 3:
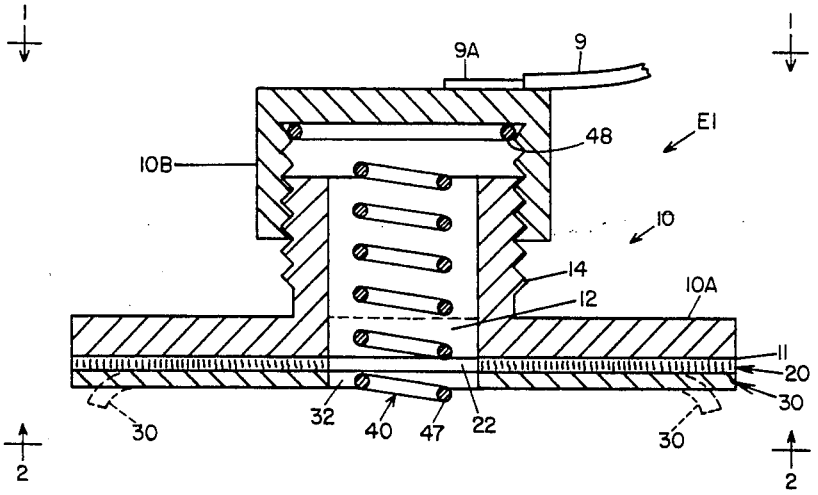
FIG. 3 is a sectional elevational view taken along lines 3—3 of FIGS. 1 and 2.

Each of the three representative embodiments (E1, E2, E3) of the electrical connector is physically attachable to the linearly generated external surface of a metallic structure (e.g. pipeline P, etc.) solely by virtue of an annular (22, 22M, 22N) resinous adhesive layer (20) that adheres along the linearly generated lower-side of a frame member (10, 50, 70) having a central-opening (12, 52M, 52N, 72) in vertical alignment with that of said annular adhesive layer (20). Disposed within the frame member upper housing portion (14, 50B, 75) is at least one electrically conductive and upwardly deflectable contact member (40, 60M, 60N, 80) protruding downwardly through vertically aligned central-openings of the laminar adhesive and the frame lower-side, whereby the contact member lowermost free-end (47, 67M, 67N, 81) is located at an elevation below adhesive layer 20 and adapted to make electrically conductive abutment with the external surface of a suitable metallic structure (e.g. pipeline P, etc.). An electrically conductive terminal member (9), which might for example be connected to a remote source of electrons, is in electrically conductive relationship (e.g. at 10B, 50A, 85) to said contact member.

Figure 1:
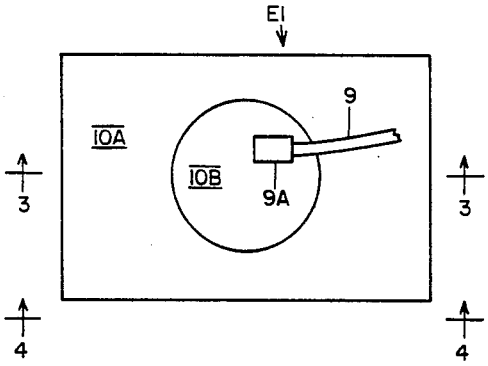
FIG. 1 is a top plan view of a representative embodiment E1 of the adhesively mountable electrical connector of the present invention and taken along line 1—1 of FIG. 3.
Figure 2:
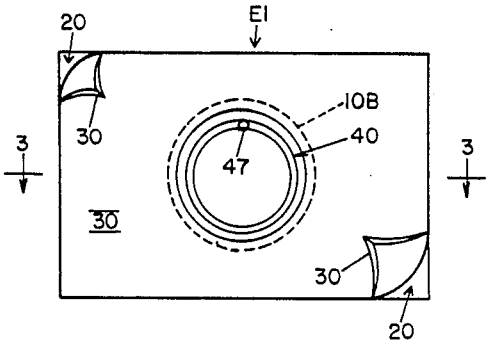
FIG. 2 is a bottom plan view of embodiment E1 and taken along line 2—2 of FIG. 3.

Turning initially to drawing FIGS. 1–3 which depict electrical connector embodiment E1 prior to an adhered condition (i.e. E1A of FIGS. 4–6) to the linearly generated external surface of a metallic structure (e.g. P). Frame member 10 comprises a metallic plate 10A having a horizontal lower-side 11 and an upwardly extending and externally threaded tubular nipple 14 that overlies frame centralopening 12. A metallic cap 10B, that is internally provided with threads and a seat for helical spring 40, loftily overlies centralopening 12 and is removably threadedly engaged with nipple 14.

Extending adherently along the frame member linearly generated lower-side 11 is a resinous adhesive layer 20; said annular adhesive 20 is provided with a central-opening 22 in vertical alignment with frame member central-opening 12. As a very desireable optional feature, adhesive layer 20 is protected on an interim basis with a releasably adherent protective layer 30 having a central-opening 32 vertically aligned with the adhesive central-opening 22. However, as will be pointed out (e.g. ancillary to FIGS. 4–6 and 13), protective layer 30 is manually peelable away from annular adhesive layer 20 immediately prior to adhesive mounting of the electrical connector to the external surface of a suitable metallic structure (e.g. P). One such, but not limiting, suitable adhesive layer 20, and in combination with a manually removable protective layer 30, is presently commercially available from the 3M Corporation of Saint Paul, Minn., under the trade designation "SCOTCH VHB No. 4945 Acrylic Foam Tape". In said 3M Corporation product, the adhesive layer is an electrically insulative resinous adhesive having a regular thickness of about 0.05 inch and that is tenaciously adherent at low temperatures (i.e. less than about 120° F.) to the metallic frame member lower-side and similarly thereafter to the external surface of a suitable metallic structure (e.g. pipeline P).

For electrical connector embodiment E1, the electrically conductive and upwardly deflectable contact member takes the form of a metallic helical spring 40 having its upper-end seated within cap 10B and having its predominate length surrounded by the frame housing nipple 14. Helical spring 40 extends downwardly through said vertically aligned central-openings whereby its lowermost free-end 47 is at an elevation below that for adhesive layer 20. Terminal member 9 is attached in electrically conductive relationship to metallic contact member 40 remote of free-end 47, such as, for example, by soldering the flattened end (9A) of terminal member 9 to metallic cap 10B.

Figure 4:
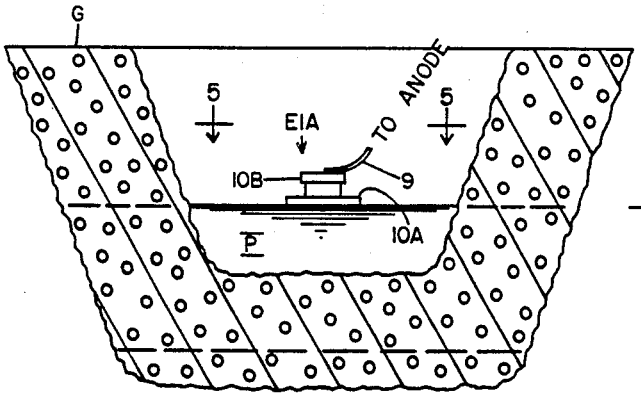
FIG. 4 is schematic side elevational view of embodiment E1 and shown in condition E1A physically adhered to a buried, but partially exposed, pipeline metallic structure.
Figure 5:
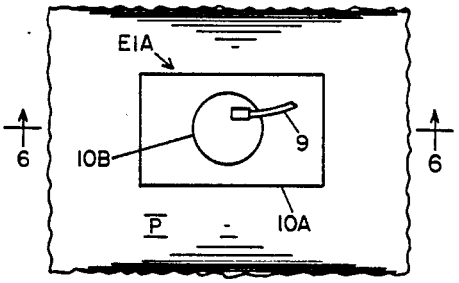
FIG. 5 is a top plan view taken along line 5—5 of FIG. 4.
Figure 6:
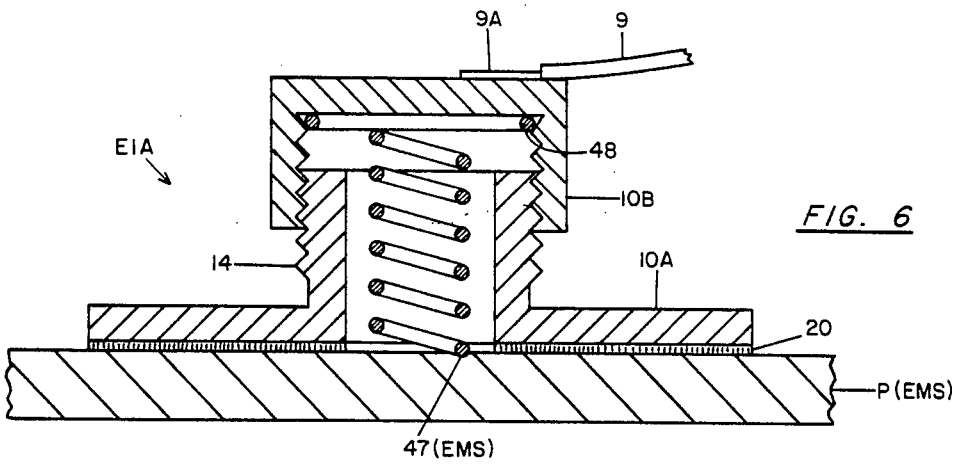
FIG. 6 is a sectional elevational view taken along line 6—6 of FIG. 5.

"E1A" denotes electrical connector embodiment E1 in that FIGS. 4–6 condition wherein protective layer 30 has been manually peeled away and the thusly exposed annular adhesive layer 20 is employed as the sole means for physically attaching embodiment E1 to the cleaned external surface of a metallic structure (e.g. P). When such physical attachmement is accomplished, by manually pressing frame member 10 against the metallic structure, contact member free-end 47 continuously remains in electrically conductive abutting relationship against the metallic structure external surface. However, by virtue of the contact member upward deflectability (i.e. compressibility of helical spring 40), helical spring free-end 47 becomes substantially co-elevational with and surrounded by annular adhesive layer 20. The legend "TO ANODE" indicates that the electrical connector terminal member 9 might be ultimately connected to an electrical wire extending from below earth G to a source of electrons for buried pipeline P. In this vein, the EMS values for metallic spring 40 and the metallic pipeline P are preferably similar. For circularly tubular pipelines having a linearly generated external surface of a relatively small radius, the frame member might be provided of a manually flexible material whereby the frame member lower-side (11, 51, 71) might be made to conform to the external contour of the metallic structure.

Figure 7:
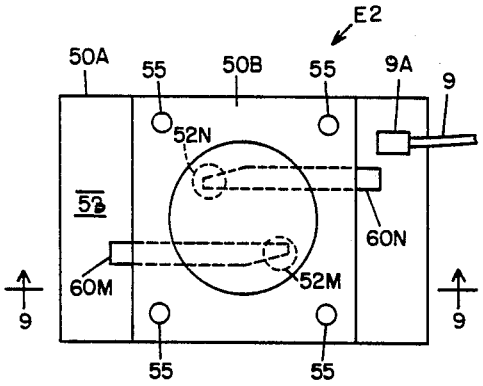
FIG. 7 is a top plan view of a second embodiment E2 of the adhesively attachable electrical connector.
Figure 8:
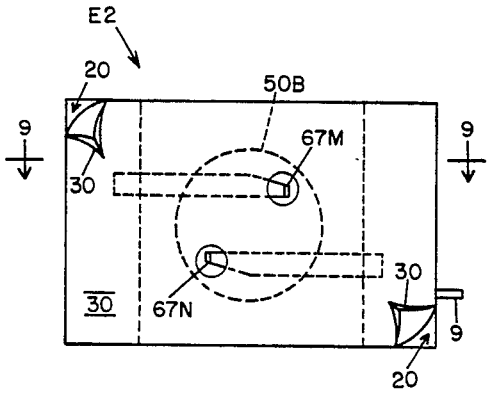
FIG. 8 is a bottom plan view of second embodiment E2.
Figure 9:
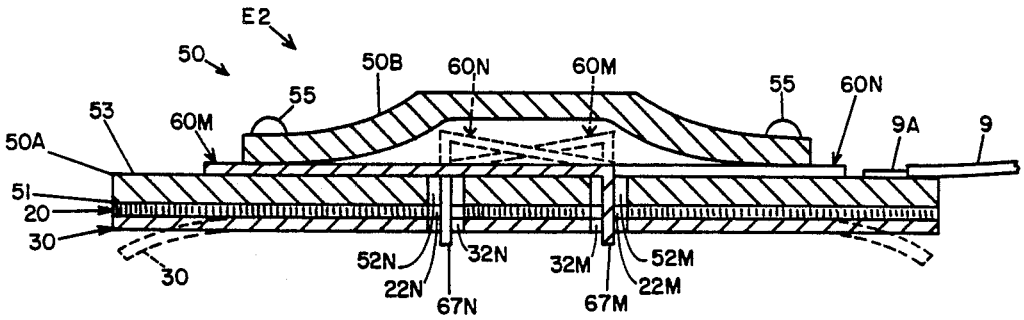
FIG. 9 is a sectional elevational view, similar to FIG. 3, and taken along lines 9—9 of FIGS. 7 and 8.

Turning next to drawing FIGS. 7–9 which depict electrical connector embodiment E2 prior to the adhered condition to the lineearly generated external surface of a metallic structure (e.g. pipeline P). Frame member 50 comprises two components, one being a metallic base-plate 50A having two horizontal planar surfaces including an upper-side 53 and a lower-side 51 and herein having two central-openings 52M and 52N. The frame member second component is a domed-plate 50B having relatively flat peripheral portions attached (e.g. at spot-welds 55) to base-plate 50A. For the electrically conductive and upwardly deflective contact member, embodiment E2 employs two metallic leaf springs 60M and 60N of substantially L-shaped configurations. The longer and horizontal arms of the respective leaf springs are secured in cantilever fashion between the attached base-plate (50A) and domed-plate (50B). The shorter and vertical arms of the respective leaf springs extend downwardly through the respective vertically aligned central-openings (22M at 52M; 22N at 52N). Accordingly, lowermost free-end 67M of leaf spring 60M and lowermost free-end 67N of leaf spring 60N are at elevations below that of annular adhesive layer 20. The central domed portion of domed-plate 50B loftily overlies leaf springs free-ends 67M and 67N. Upward deflectability of leaf springs 60M and 60N is indicated in FIG. 9 phantom line, such as will occur ancillary to the adhesive attachment of frame member base-plate 50A to the cleaned external surface of a metallic structure (e.g. P). Accordingly, these free-ends (67M, 67N) are in electrically conductive abutting relationship against the metallic structure external surface and become substantially co-elevational with and surrounded by the annular adhesive layer 20. The flattened end 9A of terminal member 9 is herein soldered to metallic base-plate 50A remote from leaf springs 60M and 60N.

Turning now to drawing FIGS. 10–12 which depict electrical connector embodiment E3 prior to the adhered condition (i.e. E3A of FIG. 13) to the external surface of a metallic structure. Frame member 70 includes a central domed portion as a housing loftily overlying the centrally-open (72) horizontally planar lower-side 71 of frame member 70. Annular adhesive layer 20 extends adherently along the frame member lower-side 71 and includes a centrally-open portion 22 in vertical alignment with frame member central-opening 72.

For embodiment E3, the electrically conductive and upwardly deflectable contact member 80 takes the form of a reticulated and compressible metallic pad (e.g. steel-wool pad FE). The metallic pad is moderately impregnated with a resinous material and to such modest extent that the metallic fibers emerge from the resinous matrix, especially at the lowrmost free-end 81 thereof. Terminal member 9 extends horizontally into and upwardly against the frame member domed portion 75 and is attached to a perforate metallic adapter member 85 having attachment tabs to terminal 9. The resinous matrix for the metallic pad extends through the adapter member perforations whereby the thusly completed contact member 80 has a constant elevation within frame member housing 75 and the lowermost free-end 81 is at an elevation below that for annular adhesive layer 20.

"E3A" denotes electrical connector embodiment E3 in that FIG. 13 condition wherein protective layer 30 has been manually peeled away and the thusly exposed annular adhesive layer 20 is employed as the sole means for physically attaching embodiment E3 to the cleaned external surface of a metallic structure (e.g. P). When such physical attachment is accomplished, by manually pressing the frame member 70 toward the metallic structure, contact member free-end 81 continuously remains in electrically conductive abutting relationship against the metallic structure external surface. However, by virtue of the contact member upward deflectability (i.e. compressiblity of the resinous-metallic pad), contact member free-end 81 becomes substantially co-elevational with and surrounded by the annular adhesive layer 20.

Drawing FIGS. 4A and 5A indicate that the FIGS. 4 and 5 installed condition (E1A) of representative electrical connector embodiment E1 can be optionally augmented to an encased condition E1B by an adhesively applied casing member 90. One such casing member (90) is presently commercially available from Royston Laboratories, Inc., of Pittsburgh, Pa., under the trade designation "HANDY CAP". A such casing member (90) comprises a perforatable transparent resinous sheath having a lower adhesive layer (91) of butyl rubber that is tenaciously adherent to the cleaned external surface of a metallic structure (e.g. pipeline P). Accordingly, such casing member (90) might offer overlying protection to the installed electrical connectors of the present invention from environmental contaminants such as water, corrosive soils and gases, etc. The tenaciously adherent butyl rubber material might also be employed as the annular adhesive component (20) for the electrical connectors (E1, E2, E3, etc.).

From the foregoing, the construction and operation of the electrical connectors of the present invention will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. Electrical connector securely attachable with a laminar adhesive to the linearly generated external surface of a metallic structure, said electrical connector comprising:

(A) a frame member including an upper-side and also a substantially horizontal and linearly generated lower-side that is provided with at least one central-opening for said frame member, and said frame member upper-side including a housing portion overlying said centrally-open lower-side;

(B) a laminar adhesive carried by and extending horizontally along said frame member lower-side and including at least one central-opening in vertical alignment with a frame member lower-side central-opening;

(C) at least one electrically conductive contact member located within said frame housing portion and including a free-end extending through said vertically aligned central-openings, whereby said free-end is at an elevation below that of the laminar adhesive, and said contact member being upwardly manually deflectable to an extent that said free-end can become substantially co-elevational with said laminar adhesive and in electrically conductive abutment with said metallic structure; and (D) an electrically conductive terminal member attached in electrically conductive relationship to said contact member remote from the free-end thereof.

2. The electrical connector of claim 1 wherein the laminar adhesive consists wholly of an electrically insulative resinous material; and wherein the laminar adhesive is protected with a releasably attached protective layer that provides the lowermost elevation of said electrical connector prior to its installation to the external surface of a metallic structure.

3. The electrical connector of claim 1 wherein the frame member upper portion comprises an upwardly extending tubular nipple and a topical cap removably attached thereto; and wherein the electrically conductive contact member comprises a metallic helical spring attached to said cap and extending downwardly therefrom through said vertically aligned central-openings.

4. The electrical connector of claim 3 wherein the cap is metallic and is removably threadedly engaged vertically alongside said nipple; wherein the helical spring is attached to said cap; and wherein the terminal member is attached to said cap.

5. The electrical connector of claim 1 wherein the frame member lower-side is defined by a substantially horizontal base-plate provided with said at least one central-opening; wherein the frame member housing portion comprises a domed-plate including relatively flat peripheral portions attached to said base-plate and also including a central domed portion overlying the base-plate central-opening; wherein the electrically conductive contact member comprises at least one metallic leaf spring secured between the base-plate and relatively flat peripheral portions of said domed-plate, and said leaf spring protruding through said vertically aligned central-openings whereby a free-end thereof is located in elevation below that of the laminar adhesive.

6. The electrical connector of claim 5 wherein said leaf spring is of L-shape including a lengthier horizontal portion that is terminally secured between said base-plate and domed-plate and also including a vertical portion extending downwardly through said vertically aligned central-openings.

7. The electrical connector of claim 6 wherein the baseplate is of metallic structural material; wherein the domed portion of the domed-plate overlies two said vertically aligned central-openings and two said leaf springs, respective vertical portions of said cantilevered leaf springs extending downwardly through respective said vertically aligned central-openings; and wherein the terminal member is attached to said base-plate.

8. The electrical connector of claim 1 wherein the electrically conductive and upwardly deflectable contact member comprises a reticulated and compressible metallic pad that is predominately located within the frame member housing portion; and wherein the terminal member extends through said housing portion and is attached to an upper portion of said reticulated pad through an intervening electrically conductive adapter.

9. The electrical connector of claim 8 wherein the reticulated metallic pad is moderately impregnated with a resinous material to such modest extent whereby the metallic fibers protrude through the resinous matrix, and said resinous matrix also adherently extending through perforations of said intervening adapter.

10. In combination with a metallic structure adapted to enclose a flowable fluid, an electrical connector attached at the linearly generated external surface of said metallic structure, said electrical connector at the metallic structure comprising:

(A) a centrally-open frame member including an upperside and a linearly generated lower-side, said linearly generated lower-side being located nearer to said external surface and being attached thereto with a centrally-open tenacious laminar adhesive of an electrically insulative resinous type whereby the sole means for physically attaching the electrical connector to the metallic structure consists of said adhesive extending laminarly between the frame member lower-side and the metallic structure external surface, and said frame member upperside including a housing portion overlying aligned central-openings of the frame member lower-side and of the laminar adhesive;

(B) an electrically conductive contact member located within said frame member housing portion and including a free-end extending into said aligned central-openings and abutting firmly against the metallic structure external surface, whereby said contact member free-end is the sole means for effecting an electrically conductive relationship between the metallic structure and the electrical connector; and (C) an electrically conductive terminal member attached in electrically conductive relationship to the contact member remote from the free-end thereof.

11. The combination of claim 10 wherein the metallic structure is a pipeline and wherein the terminal member is in electrically connected relationship to an anodic source of electrons for said electrical connector and said pipeline.

12. In combination with a buried, but partially exposed, pipeline metallic structure, an electrical connector securely attached with a laminar adhesive to a linearly generated and exposed external surface of said pipeline metallic structure, said electrical connector at the partially exposed pipeline metallic structure comprising:

(A) a centrally-open frame member including an upperside and a linearly generated lower-side, said lower-side being located nearer to said external surface and being securely attached thereto with a centrally-open laminar adhesive of an electrically insulative resinous type, and said frame member upper-side including a housing portion overlying aligned central-openings of the frame member lower-side and of the laminar adhesive;

(B) an electrically conductive contact member located within said frame member housing portion and including a free-end extending into said aligned central-openings and abutting firmly against the exposed linearly generated external surface of the pipeline metallic structure; and (C) an electrically conductive terminal member attached in electrically conductive relationship to the contact member remote from the free-end thereof.

* * * * *